US008672439B2

(12) United States Patent
Suzuki et al.

(10) Patent No.: US 8,672,439 B2
(45) Date of Patent: Mar. 18, 2014

(54) PRINTING APPARATUS

(75) Inventors: Yoshiaki Suzuki, Nagareyama (JP); Kazuhisa Kawakami, Yokohama (JP); Kenji Shigeno, Yokohama (JP); Noriyuki Aoki, Tokyo (JP); Yuji Kanome, Yokohama (JP); Kosuke Yamamoto, Yokohama (JP); Masakazu Tsukuda, Tokyo (JP); Haruo Uchida, Yokohama (JP); Hiroyuki Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 12/622,927

(22) Filed: Nov. 20, 2009

(65) Prior Publication Data

US 2010/0134552 A1 Jun. 3, 2010

(30) Foreign Application Priority Data

Dec. 2, 2008 (JP) ..... 2008-307721

(51) Int. Cl.
*B41J 29/38* (2006.01)
*B41J 29/393* (2006.01)

(52) U.S. Cl.
USPC ..... 347/16; 347/14; 347/19

(58) Field of Classification Search
USPC ..... 347/16, 19, 14, 5
See application file for complete search history.

(56) References Cited

U.S. PATENT DOCUMENTS

| | | | | |
|---|---|---|---|---|
| 5,153,655 | A | 10/1992 | Suzuki et al. | |
| 5,157,444 | A | 10/1992 | Mori et al. | |
| 5,725,319 | A | 3/1998 | Saito et al. | |
| 5,913,099 | A | 6/1999 | Kamei et al. | |
| 6,385,406 | B1 | 5/2002 | Funamizu et al. | |
| 7,104,710 | B2 | 9/2006 | Otsuka | 400/76 |
| 7,530,686 | B2 * | 5/2009 | Endo | 347/101 |
| 2002/0163568 | A1 * | 11/2002 | Takeishi | 347/101 |
| 2004/0246285 | A1 * | 12/2004 | Endo | 347/14 |
| 2005/0030600 | A1 | 2/2005 | Takagi | |
| 2005/0175386 | A1 | 8/2005 | Romine | |
| 2006/0132524 | A1 * | 6/2006 | Ikegame | 347/16 |
| 2007/0055724 | A1 | 3/2007 | Harada | |
| 2008/0112745 | A1 | 5/2008 | Saito | |
| 2008/0150992 | A1 * | 6/2008 | Endo | 347/14 |
| 2009/0152801 | A1 | 6/2009 | Shigeno | |
| 2009/0295079 | A1 | 12/2009 | Kinoshita et al. | |

FOREIGN PATENT DOCUMENTS

| | | | |
|---|---|---|---|
| CN | 1927594 | | 3/2007 |
| JP | S59-033163 | | 2/1984 |
| JP | 2006-335516 | | 12/2006 |
| JP | 2006335516 | A * | 12/2006 |
| JP | 2008-139399 | | 6/2008 |
| JP | 2008139399 | A * | 6/2008 |
| JP | 2008-239340 | | 10/2008 |

OTHER PUBLICATIONS

Chinese Office Action issued by the State Intellectual Property Office of P.R. China, dated Apr. 19, 2011, issued in counterpart Chinese Application No. 200910252407.2.
European Office Action, dated Mar. 11, 2010, issued by The European Patent Office, in Application No. 09177770.6.

* cited by examiner

*Primary Examiner* — Jason Uhlenhake
(74) *Attorney, Agent, or Firm* — Fitzpatrick, Cella, Harper & Scinto

(57) ABSTRACT

Provided is a printing apparatus including a sensor unit for measuring a moving state of a sheet by optically detecting a surface of the sheet conveyed by a conveying unit. The sensor unit measures and compares the moving states of the sheet at a first measurement position and a second measurement position which are distinct from each other in a main scanning direction, to thereby obtain information on a skew state of a skew component of the moving sheet.

10 Claims, 9 Drawing Sheets

PRINTING APPARATUS

BACKGROUND OF THE INVENTION

1. Field of the Invention

The present invention relates to a printing apparatus which conveys a sheet, and forms an image on the sheet.

2. Description of the Related Art

In order to realize formation of a high-grade image by a printing apparatus, a sheet-like printing medium (simply refereed to as "sheet" in this specification) is required to be conveyed with a high degree of accuracy.

Recently, in order to improve accuracy in conveyance control, a direct sensor which performs direct detection of the amount of movement of the sheet has been being realized. The direct detection is conducted by imaging a surface of the sheet so as to perform image processing. For example, U.S. Pat. No. 7,104,710 discloses a technology for performing the conveyance control using a direct sensor. In an apparatus disclosed in the above-mentioned U.S. patent, the direct sensor is provided on a carriage in which a print head is installed, or at a position which is opposed to a surface of a discharge port of the print head.

SUMMARY OF THE INVENTION

Use of a direct sensor enables highly accurate conveyance of a sheet. However, skew sometimes occurs during conveyance of a sheet due to poor accuracy of manufacture of one or more rollers within a conveying unit or jamming. The skewing of a sheet during conveyance causes a conveyance error containing a skew component in which the sheet under conveyance gradually veers from its intended original conveyance direction (straight advance). This skew is an especially serious problem in the conveyance of a continuous sheet, and can also become a problem in the conveyance of cut sheets.

The present invention has been made based on recognition of the above-mentioned problem. An advantage of the present invention is therefore the provision of a method of enabling measurement of the skew of the skew component during sheet conveyance by the use of a direct sensor.

According to the present invention there is provided a printing apparatus, comprising a conveying unit for moving a sheet in a first direction, a printing unit for performing printing onto the sheet, a sensor unit which is arranged to detect a surface of the sheet conveyed by the conveying unit, for measuring a moving state of the sheet, and a control unit, wherein the control unit is arranged to obtain information on the skew state of the moving sheet based on results of measurement regarding the moving state of the sheet, the sensor unit being arranged to perform the measurement at a first measurement position and a second measurement position which are distinct from each other in a second direction intersecting the first direction.

Further features of the present invention will become apparent from the following description of embodiments with reference to the attached drawings.

BRIEF DESCRIPTION OF THE DRAWINGS

In the accompanying drawings.

DESCRIPTION OF THE EMBODIMENTS

First Embodiment

Figure 1:
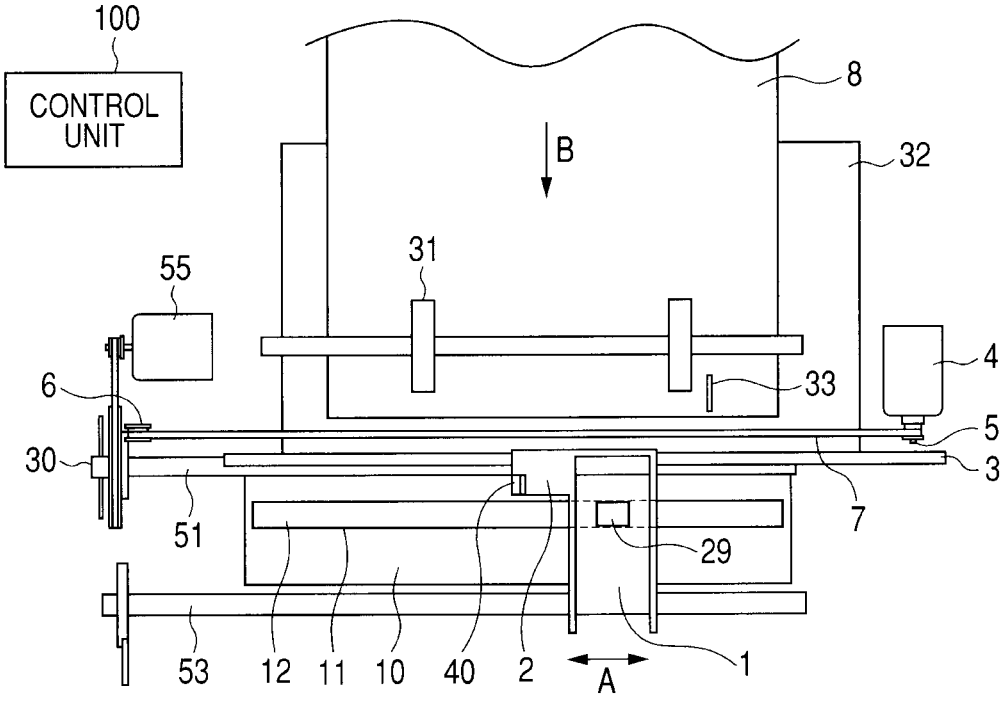
FIG. 1 is a schematic view illustrating a structure of a printing apparatus according to a first embodiment of the present invention.
Figure 2:
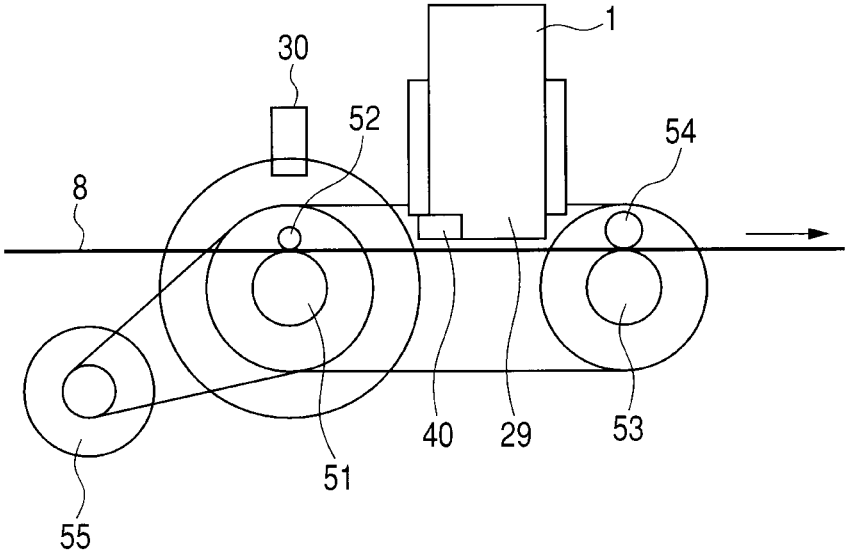
FIG. 2 is a cross-sectional view of a main portion of the printing apparatus illustrated in FIG. 1.

FIG. 1 is a schematic view illustrating a structure of a printing apparatus according to a first embodiment of the present invention, and FIG. 2 is a cross-sectional view of a main portion of the printing apparatus illustrated in FIG. 1.

The printing apparatus includes a conveying unit or means for moving a sheet 8 in a sub scanning direction (first direction) and a printing unit or means including a carriage 2 which reciprocates along a main scanning direction (second direction) while holding a print head. In the carriage 2, there is installed a direct-sensor unit or means 40 for directly measuring a moving state of the sheet by optically detecting a surface of the sheet. Other appropriate sensors, such as an RF sensor, can be utilized instead of an optical sensor.

A head cartridge 1 serving as the print head is detachably installed in the carriage 2. The head cartridge 1 has a discharge port for discharging liquid such as ink in an ink-jetting manner. The head cartridge 1 includes nozzle rows 29 having multiple discharge-energy generating elements for generating an energy for discharging the liquid, and a liquid reserving portion from which the liquid is replenished to each of the discharge-energy generating elements. Note that the present invention is applicable not only to the ink-jet printing apparatus, but also to various printing apparatuses including a thermal printer having a recording head of a thermal sublimation type or a thermal transfer type, and a dot impact printer having a recording head provided with arrayed recording elements of a dot-impact type.

The carriage 2 is supported by a guide shaft 3 fixed to a printing apparatus main body. The guide shaft 3 has a shape extending in a direction intersecting a conveyance direction in which the sheet is conveyed (hereinafter, referred to as "main scanning direction"), and the carriage 2 is capable of reciprocating in the main scanning direction (direction indicated by an arrow A of FIG. 1) within a predetermined stroke. The carriage 2 is provided with an encoder for detecting position information in the main scanning direction. The carriage 2 is driven to reciprocate by a main scanning motor 4 through driving mechanisms such as a motor pulley 5, a driven pulley 6, and a timing belt 7.

A conveying unit for conveying the sheet in the sub scanning direction during printing operation includes a first conveying roller 51, a second conveying roller 53, and a conveying motor 55 for driving the first and second conveying rollers. Further, the conveying unit includes a pinch roller 52 opposed to the first conveying roller and a pinch roller 54 opposed to the second conveying roller 53. In this case, the sub scanning direction is perpendicular to the main scanning direction. However, as long as intersecting with each other, the sub scanning direction and the main scanning direction are not necessarily accurately perpendicular to each other. Rotation of the first conveying roller 51 is read by a rotary encoder 30. The first conveying roller 51 is caused to rotate when rotation of the conveying motor 55 is transmitted thereto by a transmission mechanism including a gear and a belt. The second conveying roller 53 provided on a further downstream side in the conveyance direction compared with the first conveying roller 51 rotates simultaneously with the first conveying roller 51. Note that the second conveying roller 53 may be driven by a driving source which is the same as the driving source of the first conveying roller 51, or may be driven by a different driving source.

A platen 10 for supporting the sheet under printing from below is provided between the first conveying roller 51 and the second conveying roller 53. The platen 10 is provided with a groove 11 so as to enable borderless printing. The groove 11 holds a liquid absorber 12 for absorbing discharged liquid. The head cartridge 1 is retained above the platen 10 so that the nozzle rows 29 are positioned between the two conveying rollers 51 and 53.

The sheet 8 is a continuous sheet or a cut sheet. In the case of the continuous sheet, a web of which a long sheet is wound up into a roll is held in a holder, and therefrom a leading edge of the sheet is pulled out, to thereby be fed by a feeding roller 31. In the case of the cut sheet, the sheet is placed on a tray 32, and is fed by the feeding roller 31. A paper sensor 33 for detecting whether or not the sheet 8 is placed is provided. In feeding the sheet 8, it is possible to determine, by the paper sensor 33, whether or not feeding of the sheet 8 is normally performed or not. Further, the paper sensor 33 can also be used for fixing a position at which printing is started on the fed sheet 8. In this case, a timing for starting printing can be calculated by detecting a leading edge of the sheet 8.

A control unit or means 100 controls the entire printing apparatus, and includes a central processing unit (CPU), a memory, and various kinds of I/O interfaces.

In the above-mentioned structure, the fed sheet 8 is conveyed in a direction indicated by an arrow B of the drawings (conveyance direction) by rotation of the first conveying roller 51 in a step feeding by a predetermined amount corresponding to one band. The "one band" represents the number of recording pixels in the sub scanning direction, which are recorded in main scanning of one time. Images are formed sequentially onto the sheet by a serial printing method in which the main scanning and sub scanning are alternately repeated. In the main scanning, the ink is discharged from the print head while the carriage 2 is moved in the main scanning direction. In the sub scanning, the sheet is conveyed in a step manner by a predetermined amount in the sub scanning direction.

The direct-sensor unit 40 is fixed to the carriage 2. The direct-sensor unit 40 may be installed on the carriage 2 by being fixed to the head cartridge 1. An image sensor 42 of the direct-sensor unit 40 is positioned on a side nearer a non-reference side end portion 62 of the sheet compared with the nozzle rows 29 of the print head. Further, the image sensor 42 is positioned on a further upstream side in the sheet conveyance direction compared with the groove 11 of the platen 10.

The direct-sensor unit 40 is capable of directly measuring the moving state (conveyance amount or conveying speed) of the sheet 8 by direct sensing. The direct-sensor unit 40 is capable of performing the direct sensing by moving, integrally with the carriage 2, to an arbitrary position within the predetermined stroke in the main scanning direction.

Figure 3:
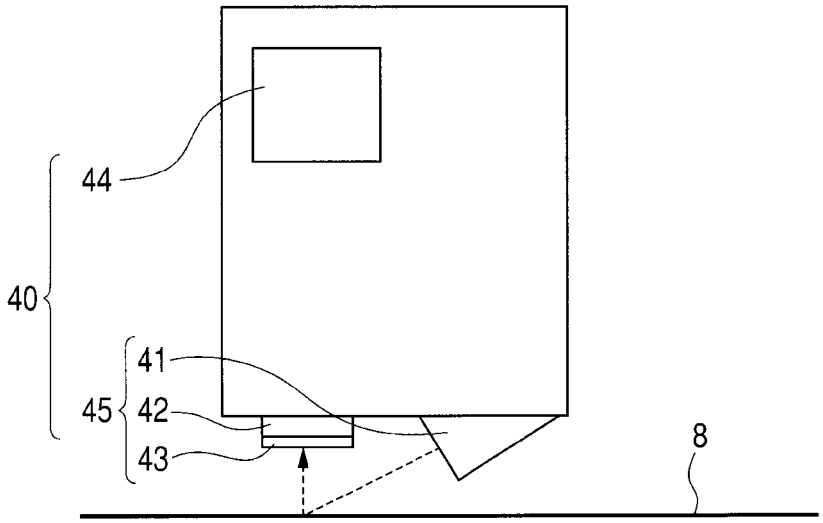
FIG. 3 is a schematic view illustrating a structure of a direct-sensor unit.

FIG. 3 is a schematic view illustrating a structure of the direct-sensor unit 40. The direct-sensor unit 40 includes an imaging section 45 for illuminating and imaging a partial region of the sheet 8 under conveyance, and an image processing section 44 for processing image data obtained by the imaging section 45. The imaging section 45 includes a light source 41 for emitting light toward the sheet 8, a lens 43, and an image sensor 42 for optically detecting the light reflected from the surface of the sheet 8 through the lens 43 to take in as the image data. As the image sensor 42, a CCD sensor or a CMOS sensor is used.

The image processing section 44 is a signal processing section for storing and processing the image data obtained by the image sensor 42. The image processing section 44 performs image processing by an image correlation method with respect to two pieces of image data each obtained by imaging performed at the same measurement position at a different time. Thus, the moving state of the sheet at the measurement position can be measured by the image processing section 44.

Note that the image of the surface of sheet to be obtained is one characterizing a state of the surface of the sheet by the reflected light. For example, the image is such an image as a shadow formed according to a surface shape of the sheet, an image pattern formed on the surface of the sheet, or a speckle pattern formed by interference of the reflected light from a coherent light source.

Figure 4A:
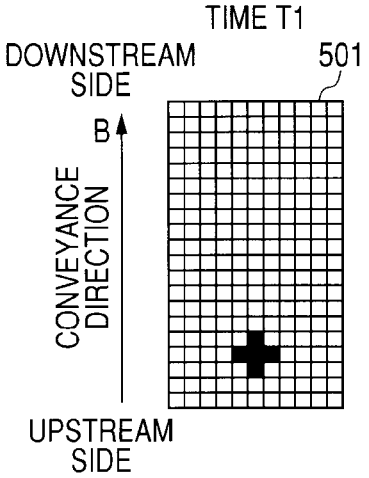
FIGS. 4A, 4B and 4C are diagrams illustrating a principle of direct sensing.
Figure 4B:
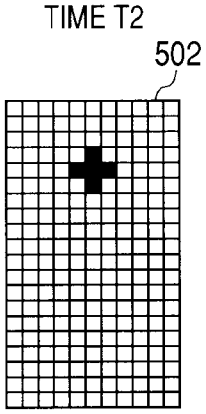
Figure 4C:
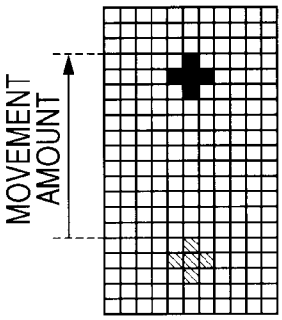

FIGS. 4A to 4C are diagrams illustrating a principle of the direct sensing. FIG. 4A illustrates image data 501 obtained by imaging performed by the image sensor 42 at a time T1. FIG. 4B illustrates image data obtained by imaging performed after the time T1, that is, at a time T2, when the sheet slightly moved. By a signal processing including a well-known pattern matching processing, it is determined whether or not a pattern same as a pattern in a certain region of the image data of FIG. 4A (though a cross pattern is used in this case, arbitrary pattern may be used in fact) exists in the image data of FIG. 4B. As a result of the determination, it is possible to obtain a movement amount M of a medium based on a displacement amount (number of pixels) as illustrated in FIG. 4C. Further, by dividing the movement amount M by a period of time between the times T1 and T2, it is possible to obtain a moving speed of the sheet 8 during the period of time. This signal processing is performed by the image processing section 44. Alternatively, the signal processing may be performed by the control unit 100.

The control unit 100 uses two detection outputs of the rotary encoder 30 and the direct-sensor unit 40 so as to perform feedback control of driving of the conveying motor 55. Detailed description thereof is made in U.S. Pat. No. 7,104,710 described above, and hence description is omitted herein.

The direct-sensor unit 40 reciprocates together with the carriage 2 so as to measure a conveying distance of the sheet 8 at multiple positions. Specifically, the direct-sensor unit 40 measures the conveying distance of the sheet 8 at a first measurement position and a second measurement position which are away from each other in the main scanning direction. The control unit 100 performs the above-mentioned feedback control of the conveying motor 55 based on the results of measurement performed at the first measurement position and the second measurement position. For example, the feedback control based on a simple average value or a weighted average value of the two measurement values enables more stable control.

Further, the control unit 100 uses the direct-sensor unit 40 so as to compare the conveying distance of the sheet 8 at the first measurement position and the conveying distance of the sheet at the second measurement position, to thereby measure a skew of the sheet 8 under conveyance. Then, the control unit 100 corrects a position at which the image is formed and the skew of the sheet 8 so that effects by the skew are reduced. The details are described later.

Hereinafter, a series of sequences of the printing operation is described. In this case, there is exemplified the case of executing the "borderless printing" in which printing is performed in the entire region including sheet edges. The sequences of the operation are performed under control by the control unit 100.

Figure 5:
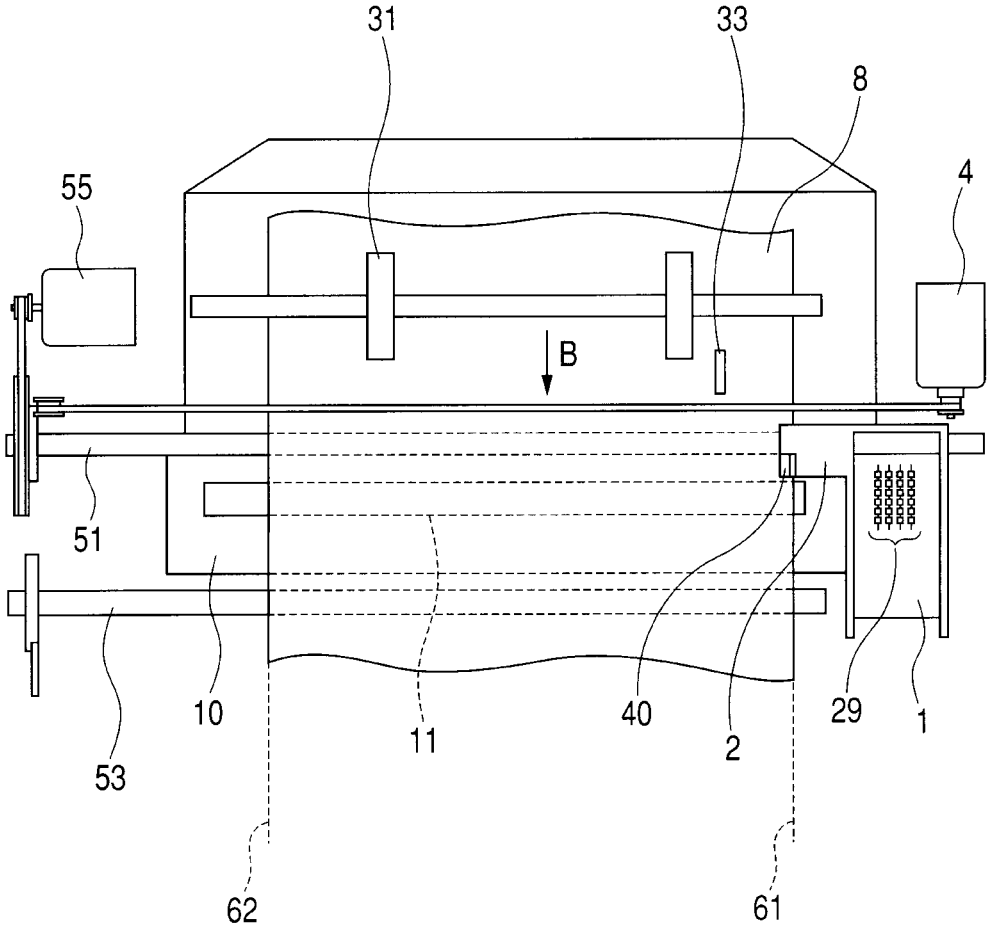
FIG. 5 is a diagram illustrating a state in which the direct-sensor unit is positioned at a first measurement position.
Figure 6:
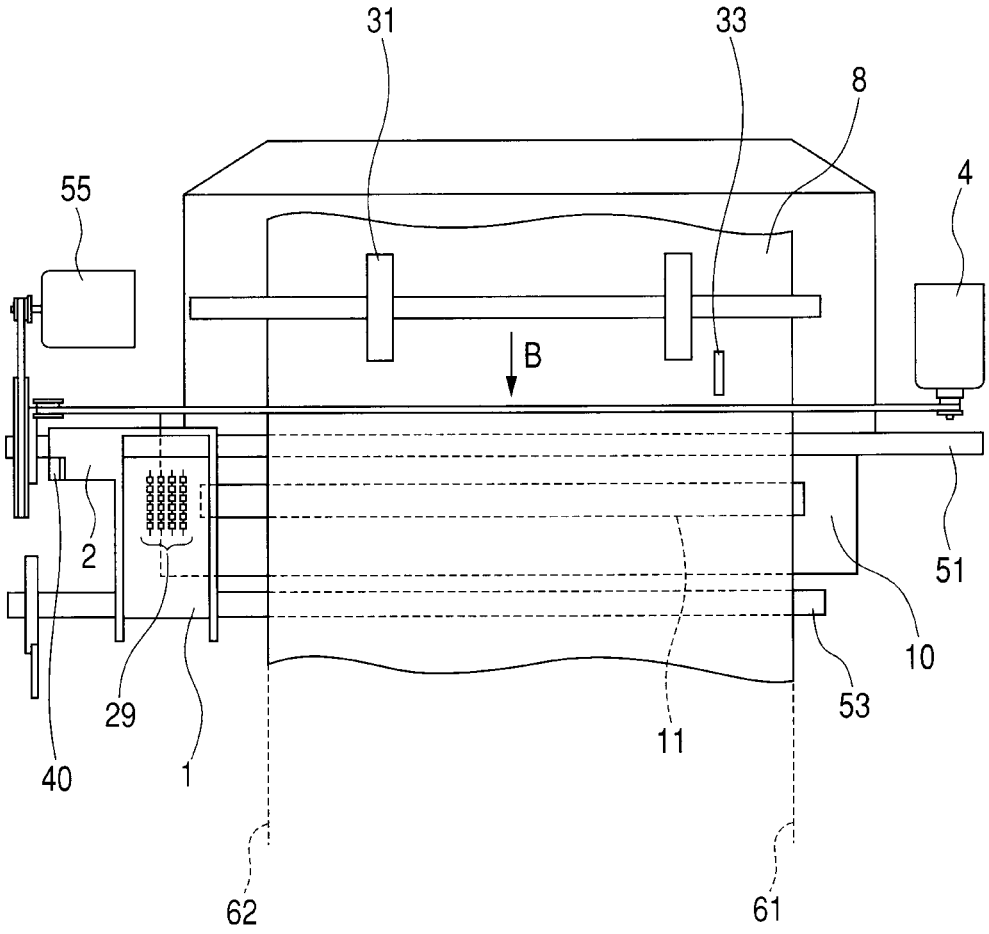
FIG. 6 is a diagram illustrating a state in which a carriage is positioned at an invert position on a non-reference side.
Figure 7:
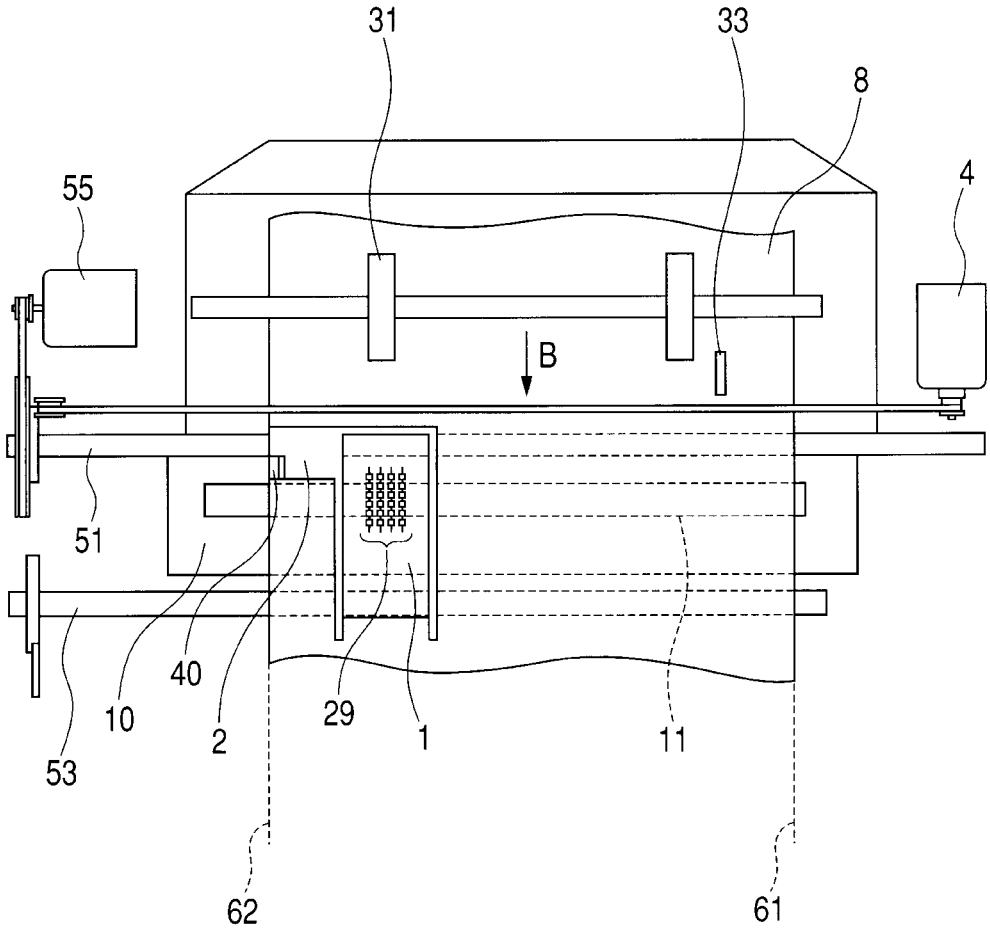
FIG. 7 is a diagram illustrating a state in which the direct-sensor unit is positioned at a second measurement position.
Figure 8:
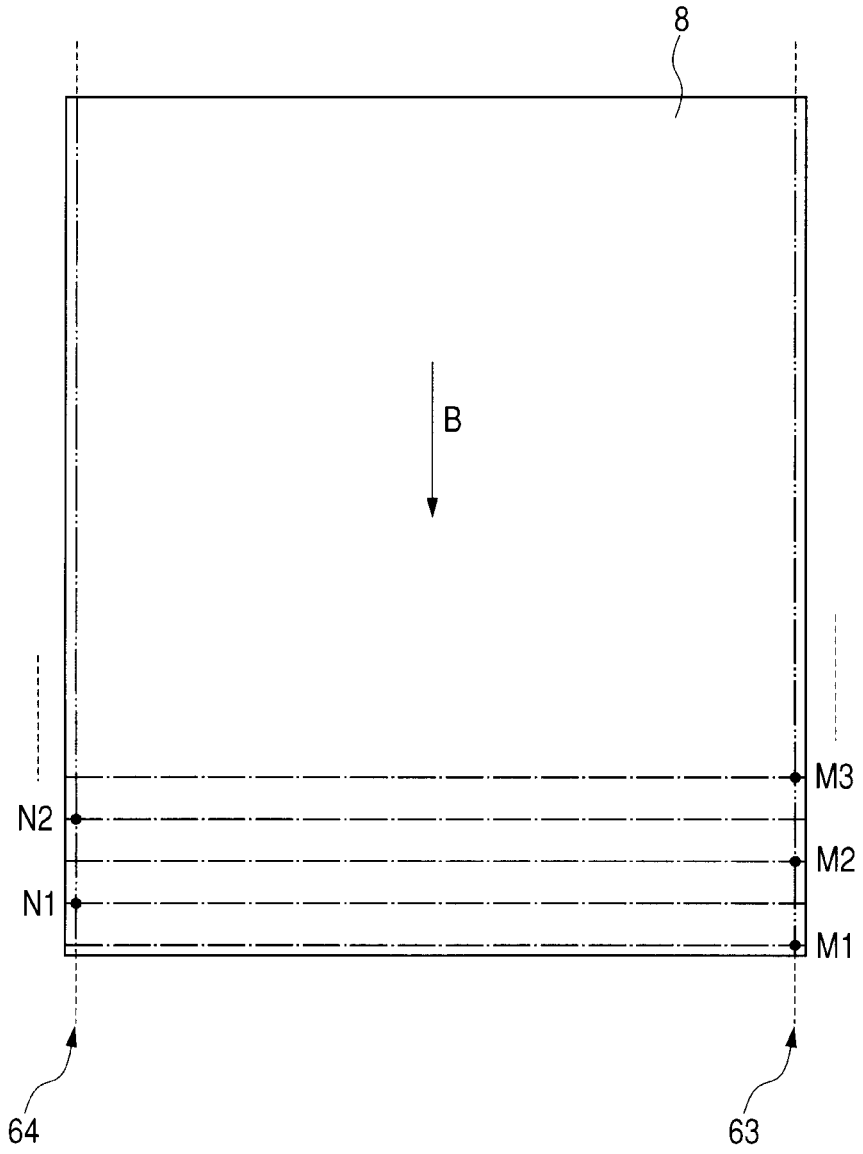
FIG. 8 is a diagram illustrating two measurement positions in a sheet under conveyance.

FIG. 5 is a diagram illustrating a state in which the direct-sensor unit 40 is positioned at the first measurement position. The carriage 2 is positioned at an invert position on the reference side within the movement stroke. FIG. 6 illustrates a state in which the carriage 2 is positioned at an invert position on the non-reference side. FIG. 7 illustrates a state in which the direct-sensor unit 40 is positioned at the second measurement position. FIG. 8 is a diagram illustrating a portion to be imaged by the direct-sensor unit 40 in the sheet 8 under conveyance.

When the printing operation is started, the sheet 8 is fed to the printing unit by the feeding roller 31. When the paper sensor 33 detects the leading edge of the sheet 8, the sheet 8 is further conveyed by a predetermined distance. Then, the leading edge of the sheet 8 abuts against a nip portion between the first conveying roller 51 and the pinch roller 52, to thereby perform registration.

The carriage 2 is moved, and stopped at the invert position on the reference side (see FIG. 5). In this case, the direct-sensor unit 40 is positioned in the vicinity of a reference side end portion 61 of the sheet 8. When the leading edge of the sheet 8 under feeding reaches the measurement position for the direct-sensor unit 40, the direct-sensor unit 40 detects the sheet 8. Then, the printing is started.

The first conveying roller 51 conveys the sheet 8 in the step manner in the sub scanning direction by the predetermined distance corresponding to one band. After this step-conveyance, imaging is performed at the first measurement position 63 (corresponding to the reference side end portion 61 of the sheet), and the image data obtained thereby is stored in a memory for subsequent calculation. In FIG. 8, of the first measurement position 63, the position at which imaging is performed for the first time on the sheet 8 is denoted by a reference symbol M1.

After that, the carriage 2 is moved from the reference side end portion 61 to the non-reference side end portion 62 of the sheet 8. When the carriage 2 is positioned at the invert position on the reference side, a distance required for the carriage 2 to accelerate from the zero velocity and then be stabilized is ensured between the nozzle rows 29 and the reference side end portion 61 of the sheet 8. Therefore, in a forward printing, it is possible to perform stable image formation from the reference side end portion 61 of the sheet 8.

While moving in the main scanning direction, the carriage 2 repeatedly discharges the ink from the nozzle rows 29 at predetermined timings. Thus, the image corresponding to one band is formed on the sheet 8. The carriage 2 stops at the invert position on the non-reference side (see FIG. 6).

In the state illustrated in FIG. 6, the direct-sensor unit 40 is not positioned on the sheet 8, and hence it is impossible to image the sheet 8. Therefore, the carriage 2 is once moved to the position illustrated in FIG. 7 so that the image sensor 42 of the direct-sensor unit 40 is opposed to the second measurement position 64 in the non-reference side end portion 62.

The first conveying roller 51 conveys the sheet 8 in the step manner in the sub scanning direction by the predetermined distance corresponding to one band. After this step-conveyance, imaging is performed at the second measurement position 64 (corresponding to the non-reference side end portion 62 of the sheet), and the image data obtained thereby is stored in the memory for the subsequent calculation. In FIG. 8, of the second measurement position 64, the position at which the imaging is performed for the first time on the sheet 8 is denoted by a reference symbol N1.

After that, the carriage 2 is returned to the invert position on the non-reference side illustrated in FIG. 6. Then, the carriage 2 is moved from the non-reference side end portion 62 of the sheet 8 to the reference side end potion 61 thereof. When the carriage 2 is positioned at the invert position on the non-reference side, a distance required for the carriage 2 to accelerate from the zero velocity and then be stabilized is ensured between the nozzle rows 29 and the non-reference side end portion 62 of the sheet 8. Therefore, similarly to the above-mentioned forward printing, also in a reverse printing, it is possible to perform stable image formation from the non-reference side end portion 62 of the sheet 8. While moving in the main scanning direction, the carriage 2 repeatedly discharges the ink from the nozzle rows 29 at predetermined timings. Thus, the image corresponding to one band is formed on the sheet 8. The carriage 2 stops at the invert position on the reference side (see FIG. 5).

The direct-sensor unit 40 is positioned at the first measurement position 63 similarly to the case when the first imaging is performed at a first imaging position M1. The first conveying roller 51 coveys the sheet 8 in the step manner in the sub scanning direction by the predetermined distance corresponding to one band. After this step-conveyance, imaging is performed at the first measurement position 63, and a new image data is obtained. In FIG. 8, of the first measurement position 63, the position at which the imaging is performed for the second time on the sheet 8 is denoted by a reference symbol M2. The new image data obtained at a second imaging position M2 is compared with the image data obtained and stored at the first imaging position M1. Thus, a sheet conveyance amount obtained between the imaging positions M1 and M2 is calculated by the signal processing. The conveyance amount obtained here is a movement distance (DM1) between M1 and M2, that is, a total movement distance of two-time step-feeding in the sub scanning direction, the two-time step feeding corresponding to one reciprocation of the main scanning. The image data obtained at the second imaging position M2 is necessary for calculating the conveyance amount between the imaging positions M2 and M3, thereby being stored in the memory. The image data obtained in advance at the first imaging position M1 is no longer necessary, and hence the image data obtained at the second imaging position M2 is overwritten thereon in the memory.

After that, printing is performed, with the carriage 2 performing main scanning. The carriage 2 is moved to the non-reference side end position 63, and second measurement is performed at the second measurement position 64. In FIG. 8, of the second measurement position 64, the position at which the imaging is performed for the second time on the sheet 8 is denoted by a reference symbol N2. Similarly, a distance (DN1) between imaging positions N2 and N1 is obtained by the signal processing.

The above-mentioned operations are repeated, and the measurement at two positions of the first measurement position 63 and the second measurement position 64 is repeated.

Thus, measurement is performed in sequence at positions (M1, N1, M2, N2, and so on) on the sheet 8. Between the measurement at each position, printing corresponding to one band is performed by the main scanning.

When printing on one page is about to end, a trailing edge of the sheet 8 deviates from the measurement position of the direct-sensor unit 40. At this stage, it is impossible to perform direct sensing. Therefore, the control unit 100 switches the control method so that the feedback control of the conveying motor 55 is performed only by the detection output of the rotary encoder 30. Then, printing is performed to the trailing edge of the sheet 8.

Simultaneously with the above-mentioned control of the serial printing operation, the control unit 100 obtains information on the skew state of the moving sheet. The information (conveyance error containing skew component) is obtained based on the results of measurement performed at each position (M1, N1, M2, N2, and so on) on the sheet 8. The method for obtaining the information is described below.

Conveyance amounts at the imaging positions Mx and Nx in local step-movement performed at the first measurement position 63 and the second measurement position 64, respectively, are compared with each other, to thereby obtain a difference therebetween. Thus, it is possible to obtain the skew information indicating a direction (rotating direction of the skew) and a degree of the local skew. For example, a distance (DM1) between the imaging positions M1 and M2 and a distance (DN2) between the imaging positions N1 and N2 is compared to calculate a difference (DM1−DN1=D1) therebetween. The direction of the skew can be determined based on whether the obtained value is positive or negative, and the degree of the skew can be determined based on the absolute value thereof. In the example illustrated in FIG. 8, when the value of the difference D1 is positive, the sheet 8 is skewed clockwise in FIG. 8. In contrast, when the value of the difference D1 is negative, the sheet 8 is skewed counterclockwise therein.

Further, when the average value of multiple measurement values is obtained for comparison, it is possible to obtain the skew information within the range. Further, when comparison is made between the average value of all the conveyance amounts obtained at the first measurement position 63 and the average value of all the conveyance amounts obtained at the second measurement position 64 so as to obtain a difference therebetween, it is possible to obtain the skew information indicating the direction and the degree of the skew as a whole.

As a distance between two measurement positions is large, the measurement results sensitively reflect the skew during conveyance of the sheet, and hence measurement accuracy is improved. The first measurement position 63 and the second measurement position 64 are at both edges of the sheet to be used, and hence high measurement accuracy is realized. In the case where sheets each having a different width are used, it is sufficient to set the first measurement position 63 and the second measurement position 64 according to the width of each sheet.

Based on the skew information obtained in this manner, the control unit 100 interrupts the continuous printing operation of the image when the unacceptable degree of skew occurs. Then, the control unit 100 instructs a user to set the sheet again. This reset operation is effective in the case where large skew occurs in jamming during conveyance.

Further, when the skew is slight, it is also possible that the device automatically performs correction so as to reduce effects by the skew (such as white line partially formed on the image) in image printing of this embodiment. Some methods can be used for the correction. First, image correction for correcting the image to be formed is exemplified. In the image correction, the control unit 100 adjusts ink discharge control at the time of the main scanning of the carriage 2, and the position at which the image is formed is corrected by the amount of displacement of the sheet with respect to the original position, the displacement being caused by the skew. As another method, it is also possible to correct conveyance so as to correct the skew physically. For example, it is possible that the pinch rollers 52 opposed to the conveying roller 51 are arranged at separate positions in the width direction, and a nip pressure is made different between the pinch rollers 52 provided separately. As a result, the advancing direction of the sheet can be finely adjusted. The timing for the automatic correction is set as follows. In the case of continuous image printing, the correction is performed, based on the skew information obtained in the image printing on a certain page, in the image printing on a following page. Alternatively, real-time correction may be performed during the image printing on one page.

In the following, examples of the real-time image correction are described. Similarly to the above, the case of comparing the distance (DM1) between the imaging positions M1 and M2 and the distance (DN1) between the imaging positions N1 and N2 is assumed. When the absolute value of the difference D1 therebetween exceeds a predetermined value (for example, value corresponding to one nozzle-pitch (42.3 μm in the case of 600 dpi)), it is determined to perform the automatic correction. In the case of performing the correction, each of the distances DM1 and DN1 is compared with an ideal feeding amount ID, to thereby calculate a difference with the ideal feeding amount ID. By this calculation, a cause of the clockwise skew (which occurs when the value obtained by the formula DM1−DN1 is positive) is revealed. Specifically, it is revealed whether the clockwise skew occurs because the feeding amount for the distance DM1 is larger than the ideal amount, or because the feeding amount for the distance DN1 is smaller than the ideal amount. Note that the ideal feeding amount used for calculation herein may be the conveyance amount of the sheet which has been fed actually. If the distance DM1 is larger than the ideal feeding amount, the feeding amount in the next time is corrected and reduced so as to approximate the ideal feeding amount, and the image correction is made by thinning the substantially half of the image on the side of the distance DM1 in the sub scanning direction by the amount of one nozzle. In contrast, if the feeding amount on the side of the distance DN1 is smaller than the ideal feeding amount, the feeding amount in the next time is not corrected, and the image correction is made by thinning the substantially half of the image on the side of the distance DM1 in the sub scanning direction by the amount of one nozzle. Meanwhile, when the value obtained by the formula DM1−DN1 is negative, it is determined that the direction of the skew is counterclockwise in FIG. 8, and correction processing contrary to the above-mentioned processing is performed. After that, similarly to the above, comparison is sequentially made between the distances DM2 and DN2, DM3 and DN3, and so on, to thereby perform correction. By the above-mentioned image corrections, it is possible to prevent the white line from being formed partially on the image to be formed.

Second Embodiment

Figure 9:
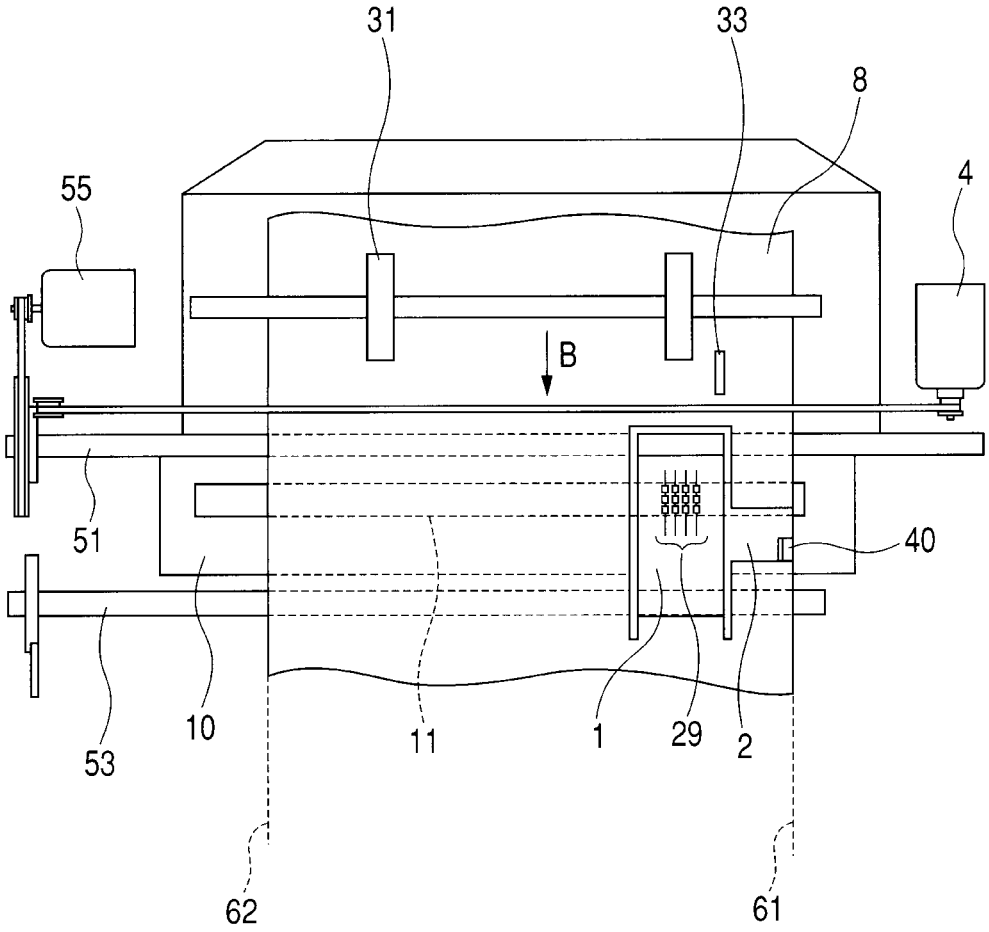
FIG. 9 is a diagram illustrating a printing apparatus according to a second embodiment of the present invention.

Description is made on a second embodiment of the present invention. In this example, as illustrated in FIG. 9, the direct-sensor unit 40 installed in the carriage 2 is positioned on a side nearer the reference side end portion 61 compared with the nozzle rows 29 of the print head. Further, the direct-sensor unit 40 is provided on the further downstream side compared with the groove 11 of the platen 10. Other components are the same as those in the first embodiment. Hereinafter, description is mainly made on differences with the first embodiment.

After the registration of the leading edge of the sheet, the carriage 2 is moved so that the direct-sensor unit 40 is opposed to the vicinity of the reference side end portion 61 of the sheet 8 (see FIG. 9). The first conveying roller 51 conveys the sheet 8 in the step manner in the sub scanning direction by the predetermined distance corresponding to one band, and the direct-sensor unit 40 performs first measurement at the first measurement position 63.

Figure 10:
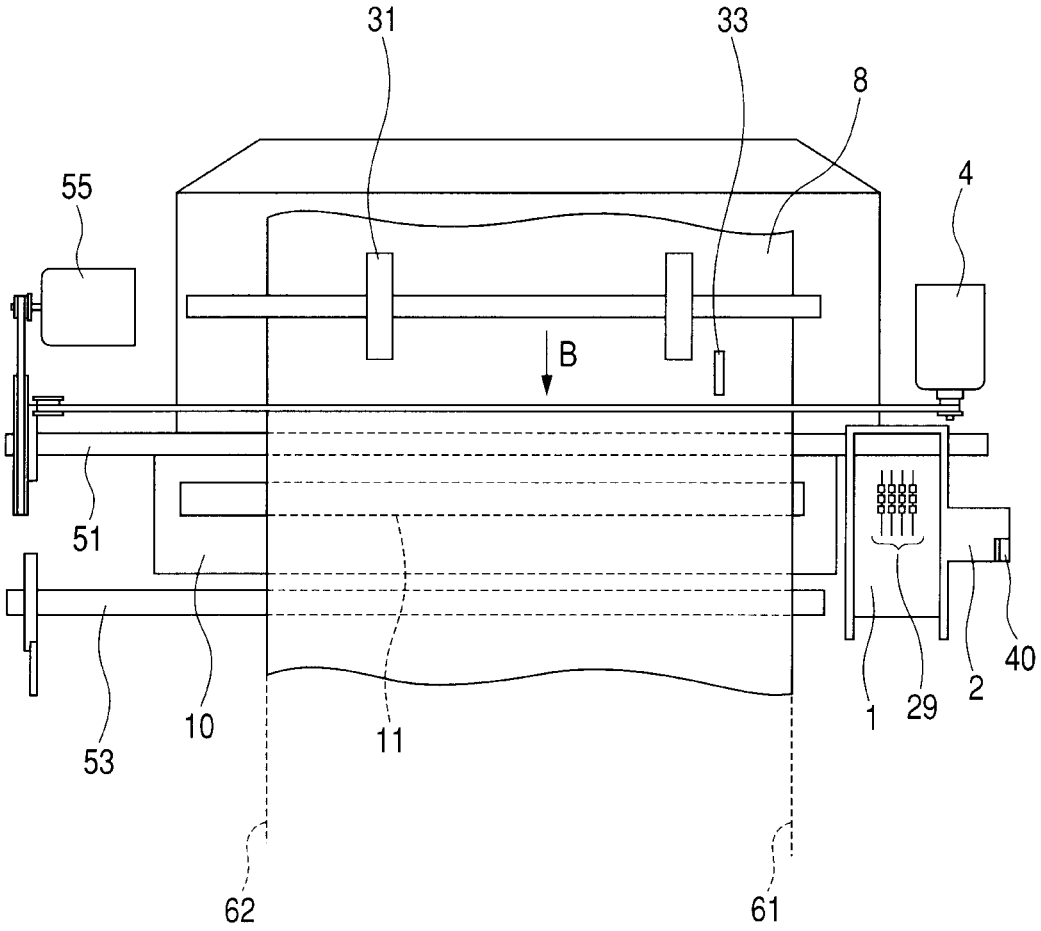
FIG. 10 is a diagram illustrating a state in which the carriage is positioned at an invert position on a reference side.
Figure 11:
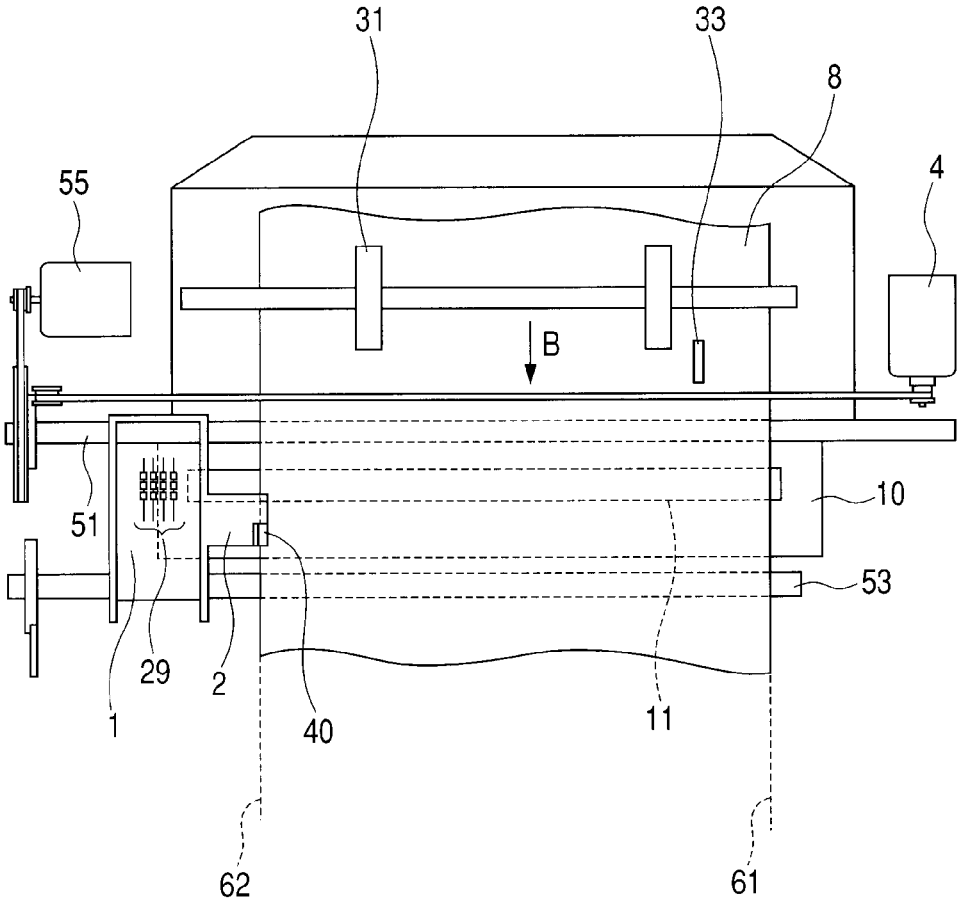
FIG. 11 is a diagram illustrating a state in which the carriage is positioned at an invert position on a non-reference side.

After that, in order to start image formation, the carriage 2 is moved to the invert position on the reference side (see FIG. 10). Then, while moving in the main scanning direction, the carriage 2 repeatedly discharges the ink from the nozzle rows 29 at predetermined timings. Thus, the image corresponding to one band is formed on the sheet 8. The carriage 2 stops at the invert position on the non-reference side (see FIG. 11). The direct-sensor unit 40 is opposed to the second measurement position 64. The first conveying roller 51 conveys the sheet 8 in the step manner in the sub scanning direction by the predetermined distance corresponding to one band, and the direct-sensor unit 40 performs the first measurement at the second measurement position 64.

The above-mentioned operations are repeated, and the measurement at two positions of the first measurement position 63 and the second measurement position 64 is repeated. Thus, measurement is performed in sequence at each position (M1, N1, M2, N2, and so on) on the sheet 8. Between the measurement at each position, printing corresponding to one band is performed by the main scanning.

The direct-sensor unit 40 is provided on the further downstream side compared with the groove 11 of the platen 10. Therefore, even after the trailing edge of the sheet 8 is released from nipping by the first conveying roller 51, direct sensing can be performed. Therefore, conveyance can highly accurately be performed to the most trailing edge of the sheet, thereby enabling high-quality borderless printing.

In the embodiments described above, the direct-sensor unit 40 is installed in the carriage 2. However, the present invention is not limited to the mode in which the sensor is installed in the carriage. The direct-sensor unit may be provided on the platen or in the vicinity thereof. As one mode, it is also possible to adopt a mode in which one sensor is provided on the platen 10 or in the vicinity thereof so as to be movable in the main scanning direction at least between the first measurement position and the second measurement position. Further, as another mode, it is also possible to adopt a mode in which a first sensor is provided correspondingly to the first measurement position, and a second sensor different from the first sensor is provided correspondingly to the second measurement position. The first sensor and the second sensor may be immovably fixed. Alternatively, one of or both of the sensors may be movable within a limited range in the main scanning direction according to variations of widths of the sheet to be used. In any modes, the direct-sensor unit measures the moving state of the sheet at least at the first measurement position and the second measurement position which are away from each other in the direction intersecting to the conveyance direction of the sheet. As a result, it is possible to obtain the information on the skew state of the moving sheet. Note that the measurement may be performed not at two positions of the first measurement position and the second measurement position, but at three or more positions.

Further, the above-mentioned embodiments adopt the serial printing method in which sheet conveyance in the sub scanning direction performed by the conveying unit and movement of the print head in the main scanning direction performed by the carriage are alternately performed. However, the present invention is not limited to this method, and may adopt a line printing method using an elongated line-type print head. A mode in which the above-mentioned direct-sensor unit is not installed in the carriage is effective in a line printer.

In the embodiments described above, the direct sensor which measures the moving state based on the image data obtained by imaging performed by the image sensor is exemplified as the sensor unit. However, the present invention is not limited to this mode, and it is also possible to use a direct sensor of other type, which directly measures the moving state of an object by optically detecting the surface of the object. As such sensor, a Doppler velocity sensor is exemplified. The Doppler velocity sensor, which includes a coherent light source such as a laser and a light-receiving element, measures the moving speed of the object by receiving light reflected from the object which is irradiated with light and by capturing a phenomenon that movement of the object causes a Doppler shift in a light receiving signal. The direct-sensor unit in the above-mentioned embodiments may be replaced by the Doppler velocity sensor, to thereby measure the moving state of the sheet or a rotary body at the same measurement positions.

While the present invention has been described with reference to exemplary embodiments, it is to be understood that the invention is not limited to the disclosed exemplary embodiments.

This application claims the benefit of Japanese Patent Application No. 2008-307721, filed Dec. 2, 2008, which is hereby incorporated by reference herein in its entirety.

What is claimed is:

1. A printing apparatus, comprising:

a conveying unit configured to convey a sheet in a first direction;

a carriage, holding a print head, configured to reciprocate along a second direction intersecting the first direction for performing serial printing onto the sheet by repeating print steps with the print head and conveyance steps with conveying unit;

a sensor unit mounted on the carriage configured to measure a moving amount of the sheet in the first direction; and a control unit configured to control such that, in accordance with reciprocation of the carriage, the sensor unit performs a first measurement to measure a moving amount of the sheet at a first position in a vicinity of one side of the sheet when one of the conveyance steps is performed, then performs a second measurement to measure a moving amount of the sheet at a second position in a vicinity of the other side of the sheet when the next one of the conveyance steps is performed, wherein the control unit is configured to obtain information on a skew state of the sheet, by comparing a result of the first measurement with a result of the second measurement.

2. A printing apparatus according to claim 1, wherein the sensor unit comprises an optical sensor to directly measure a moving amount of the sheet.

3. A printing apparatus according to claim 2, wherein the sensor unit comprises an image sensor, and measures the conveyance amount by performing signal processing of image data which is obtained by imaging the surface of the sheet by the image sensor.

4. A printing apparatus according to claim 1, wherein:

the sheet comprises a continuous sheet; and the printing unit performs printing by an inkjet method.

5. A printing apparatus according to claim 1, wherein the control unit calculates a difference between the result of the first measurement and the result of the second measurement so as to obtain the information on the skew state of the sheet.

6. A printing apparatus according to claim 5, wherein the sensor unit detects different positions on the sheet at one side and the other one side set in order in the first direction, and the control unit calculates a first average value of the result of first measurements at the different positions at the one side and a second average value of the results of second measurements at the different positions at the other one side so as to calculate a difference therebetween.

7. A printing apparatus according to claim 1, wherein the control unit is configured to control at least one of the conveying unit and the printing unit, based on the obtained information.

8. A printing apparatus according to claim 7, wherein the control unit is configured to control correction so as to reduce the effect of the skew in printing, based on the obtained information.

9. A printing apparatus according to claim 1, wherein the control unit is configured to control interruption of the printing operation, based on the obtained information.

10. A printing apparatus according to claim 1, wherein in the serial printing, the print head performs printing onto the sheet in units of an image corresponding to one band and the conveying unit conveys the sheet in the first direction in units of a predetermined distance corresponding to the one band.

* * * * *